US005109685A

United States Patent [19]

Westwinkel

[11] Patent Number: 5,109,685

[45] Date of Patent: May 5, 1992

[54] CONTROL KEY FOR EXTENSION ADAPTER

[75] Inventor: Florian G. Westwinkel, Toronto, Canada

[73] Assignee: Pundra Industries Limited

[21] Appl. No.: 686,413

[22] Filed: Apr. 15, 1991

Related U.S. Application Data

[63] Continuation-in-part of Ser. No. 493,809, Mar. 15, 1990, abandoned.

[51] Int. Cl.[5] ..... E05B 19/08; E05B 29/04

[52] U.S. Cl. ..... 70/368; 70/369; 70/395; 70/400

[58] Field of Search ..... 70/395, 396, 400, 401, 70/411, 369, 368; 411/504, 506

[56] References Cited

U.S. PATENT DOCUMENTS

| | | | |
|---|---|---|---|
| 602,561 | 4/1898 | Loomis | 70/395 |
| 1,587,686 | 6/1926 | Varnum | 70/400 |
| 1,969,010 | 8/1934 | Jacobi . | |
| 1,979,798 | 11/1934 | Glidden | 70/395 |
| 1,986,676 | 1/1935 | Hurd . | |
| 2,061,456 | 11/1936 | Falk . | |
| 2,065,683 | 12/1936 | Gahagan | 70/224 |
| 2,291,655 | 8/1942 | Schlage | 70/224 |
| 2,460,709 | 2/1949 | Navarro . | |
| 2,591,652 | 4/1952 | Ziegliss | 70/395 |
| 3,083,561 | 4/1963 | Sussina | 70/379 R |
| 3,338,078 | 8/1967 | Eberitch et al. | 70/395 |
| 3,383,886 | 5/1968 | Hermann . | |
| 3,667,262 | 6/1972 | Hill | 70/384 |
| 3,713,310 | 1/1973 | Surko, Jr. | 70/337 X |
| 3,790,283 | 11/1976 | Nelson | 70/308 |
| 3,863,475 | 2/1975 | Foss | 70/360 |
| 4,191,037 | 3/1980 | Patriquin | 70/369 |
| 4,272,975 | 6/1981 | Patriquin | 70/369 |
| 4,712,400 | 12/1987 | Steinbach | 70/369 |
| 4,875,352 | 10/1989 | Smallegan et al. | 70/395 |

FOREIGN PATENT DOCUMENTS

| | | | |
|---|---|---|---|
| 289878 | 9/1966 | Australia | 70/395 |
| 726399 | 1/1966 | Canada . | |
| 850900 | 9/1970 | Canada . | |
| 887387 | 12/1971 | Canada . | |
| 934566 | 10/1973 | Canada . | |
| 954326 | 9/1974 | Canada . | |
| 1038186 | 9/1978 | Canada . | |
| 1175669 | 10/1984 | Canada . | |
| 265993 | 7/1929 | Italy | 70/411 |
| 561110 | 1/1959 | Italy . | |
| 72586 | 9/1931 | Sweden . | |

*Primary Examiner*—Lloyd A. Gall

*Attorney, Agent, or Firm*—Blake, Cassels & Graydon

[57] ABSTRACT

A bitted substantially rigid extension adapter is provided which may be applied to an existing operating key thereby forming a control key assembly. The extension adapter is provided with fasteners for secure attachment to an operating key. The extension adapter may be made of metal. The bitted portion of the adapter may activate one or more control tumblers in a removable locking core housed within a locking mechanism. The adapter and key, when combined, may be used to remove the locking core from the mechanism.

22 Claims, 3 Drawing Sheets

CONTROL KEY FOR EXTENSION ADAPTER

This is a continuation in part of application Ser. No. 493,809, filed Mar. 15, 1990 which is abandoned on filing of this application.

FIELD OF THE INVENTION

This invention relates to locking mechanisms and in particular, the keys used to operate locking cores housed within locking mechanisms.

BACKGROUND OF THE INVENTION

It is common for locking systems to provide separate operating keys and control keys for use with rotatable locking cores. An operating key is employed to lock and unlock a corresponding core when the core is housed in the locking mechanism. For example, if a locking mechanism is installed to secure a desk drawer against opening when locked, the operating key may be used to lock and unlock the core, thereby in turn, permitting the secure closure and opening, respectively, of the drawer.

A control key may be used for additional functions including, acting as a master key to operate a number of different locking cores or as a key to permit removal of a locking core from its corresponding housing. Typically, a control key is provided with a bitted portion which is capable of activating one or more control tumblers in a locking core. When such control tumblers are activated, usually upon insertion and rotation of the control key to a predetermined position, removal of the locking core from the housing may be achieved. Alternately, where a control key functions as a master key, the bitted portion of the control key is adapted to activate the tumblers in a number of different locking cores which use separate operating keys.

In locking systems of the prior art, the manufacture and use of separate operating keys and master keys gave rise to inherent disadvantages.

Moreover, the prior art includes a number of two part keys for use as security keys. The underlying theory is that one person should keep one part of the key and another person should keep another part of the key and that only when the parts are combined is the lock operable. Such a two part key is disclosed by Glidden in U.S. Pat. No. 1,979,798. Such keys, in their shaft portion where torque is appreciable on turning the key, may be subject to separation of the shaft parts due to different torques on different parts of the shaft. To provide a combination key when the broken shaft is splinted to minimize breaking apart of the parts on application of torque may have been thought impracticable due to the width of most keyways. In any event two part keys having lateral shaft support are not presently known to the applicant.

SUMMARY OF THE INVENTION

According to the invention there is provided a control key extension for use in combination with an operating key having an elongate flattened bitted shaft having bits extending therefrom in a major plane of the shaft and having a proximal end and a distal end, an operating lever being provided at the proximal end. The extension comprises; a bitted shaft extending portion having one end adapted to engage the distal end of the operating key to locate a major plane of the extending portion in the major plane of the operating key to extend it at the distal end of the key, and having at least one bit projecting therefrom to lie in the major plane of the key when the end of the extending portion engages the distal end of the key; a lever end having engagement means for engaging the key operating lever; and an elongate thin web connecting the extending portion and the lever end, the web having a first surface adapted to fit flush with the flattened bitted shaft of the key and a second surface parallel to the first surface and its plane parallel with the major plane of the extending portion, Thus, when the one end of the extending portion engages the distal end of the key, it splints the key against torque.

The invention may also include a combination of the assembled operating key and the extension, and a kit comprising the operating key, the extension and a locking core.

The engagement means may comprise a member such as an open sleeve upstanding from a planar surface of the lever and adapted to engage in an aperture in the operating lever of the key and hence engage proximal ends of the key and extension. The height of the sleeve on other members may substantially correspond to the thickness of the key. An alternative engagement means may be a resilient flange upstanding from the lever end adapted to form a snap-lock engagement with the operating lever of the key.

The extension is engagable with the key at the distal end of the key by a wall at one end of the extending portion, the wall being contoured for engagement with the distal end of the key and upstanding from the first surface of the web. The height of the wall may correspond generally to the thickness of the key less the thickness of the web.

The operating key shaft may be provided with a groove along its length and the web of the extension may be provided with a longitudinally extending rib upstanding from the first surface of the wall, the rib being contoured for registration with the groove of the key. Such rib and groove may help vertical stability of the extension web and key shaft.

In locking systems of the prior art, the manufacture and use of separate operating keys and master keys gave rise to inherent disadvantages.

BRIEF DESCRIPTION OF THE INVENTION

Drawings are appended hereto which illustrate exemplary embodiments of the present invention:

DETAILED DESCRIPTION OF PREFERRED EMBODIMENTS

Figure 1:
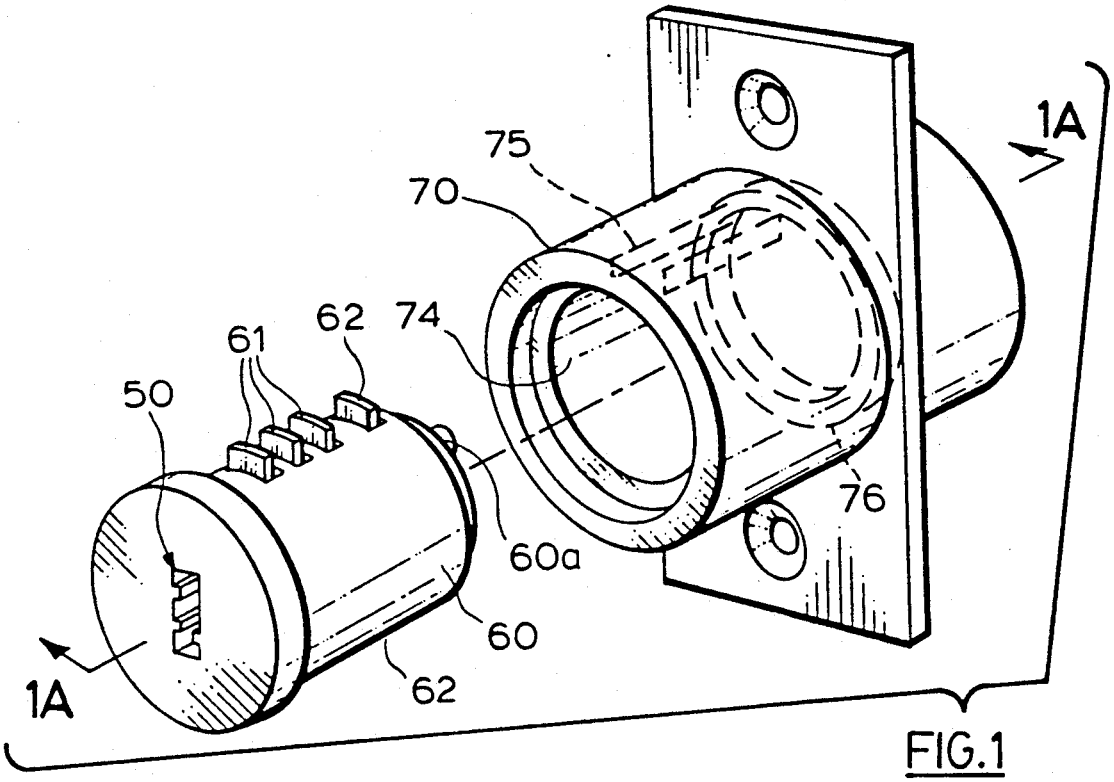
FIG. 1 is an exploded view of a locking mechanism in perspective comprising a locking core and a housing.
Figure 1A:
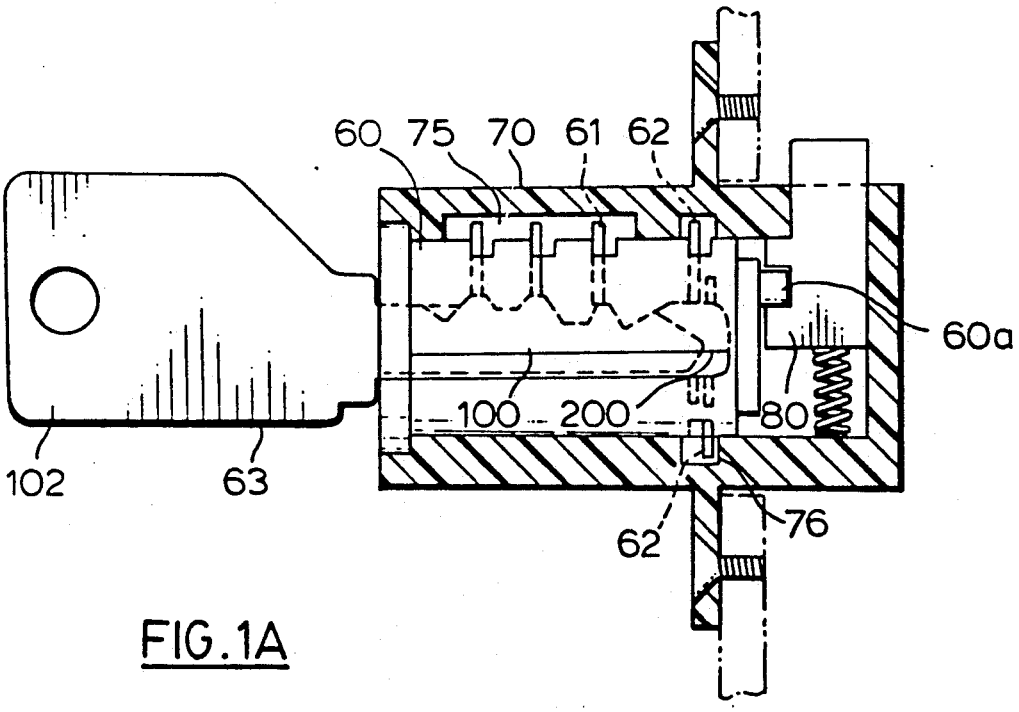
FIG. 1A is a sectional view along line 1A—1A in FIG. 1, showing a locking core activated by an operating key and a control key.

FIGS. 1 and 1A show a typical locking core assembly 60 and a lock housing 70. The core 60 is received in chamber 74 of the housing. Locking tumblers 61 are received in channel 75. When the key is not in place locking tumblers are positioned such that the locking core will not rotate within the housing. When operating key 63 having an operating lever 102 at a proximal end and a bitted shaft portion 100 is inserted into the keyway 50, tumblers 61 are retracted and the locking core may be rotated. Upon rotation of the core, pin 60*a* will displace a spring loaded locking bar assembly 80 to unlock a storage compartment or other lockable device.

At least one or, as shown, two control tumblers 62 are also provided. Control tumblers 62 are engaged with channels 76 in the housing when the key is not in place or when the unextended key is in place preventing removal of the locking core 60. When the operating key provided with a control key extension 263 is in place, control tumbler 62 and operating tumbler 61 are all located to permit removal of the entire locking core 60 from the housing 70.

It is to be understood that the foregoing embodiment of a locking core assembly is only one example of a number of different types of locking systems to which the present invention may be applied. For example multiple or single control pins or tumblers may be provided in the locking core. Alternately, the operating and control tumblers may be situated in the housing such that shear pins housed within the locking core may be displaced by the bitted portion of the appropriate key to form a shear line permitting rotation or withdrawal of the core, as the case may be. All of these variations are readily understood in the prior art.

Figure 6:
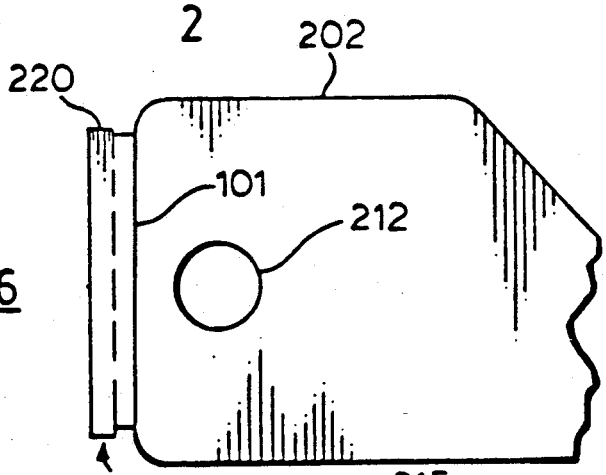
FIG. 6 is a plan view of a detail of another embodiment of the present invention.
Figure 7:
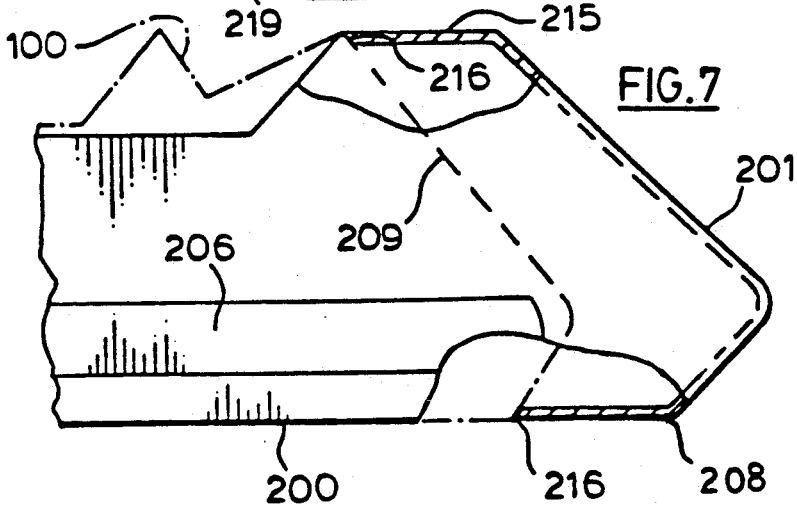
FIG. 7 is a plan view of a detail of yet another embodiment of the invention.
Figure 5:
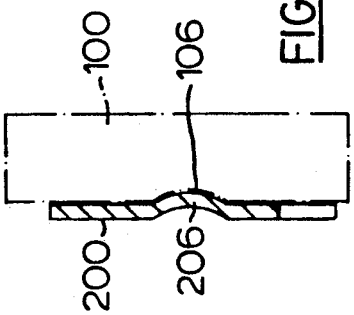
FIG. 5 is a section on the line 5—5 of FIG. 2.

The control key extension 263 of the present invention comprises a bitted extending portion 201, rigid intermediate web 200 and lever end 202. The bitted extending portion 201 may comprise an upstanding wall 210 to engage a distal end of key 63. The upstanding wall may be part of a solid bitted extending portion 201 as shown in FIGS. 2-6 or it may be rib as illustrated in FIG. 7 which extends round the distal end of the extending portion as rib 208. The web 200 has a first surface adapted to fit face to face with a face of the bitted shaft portion 100 of the operating key. The web 200 has a second face parallel to its first face and the plane of the web 200 is parallel with a major plane of the extending portion.

A sleeve 212 may be stamped, cast, rolled or otherwise incorporated into the extension 263 at its lever end 202. The sleeve 212 snugly fits into a corresponding hole 112 in the operating key. Wall 210 engaging the distal end of key 63 and sleeve 212 engaging proximal end of key 63, together receive and hold key 63.

Sleeve 212 may be manipulated to secure the extension 263 to the operating key 63 either before or after the operating key 63 is placed into the keyway. For example, sleeve 212 may be pressed to tightly fit the corresponding hole 112. Added securement features such as crimping of the terminal ends of the sleeve may be provided, if desired.

With reference to the foregoing description, it is to be understood that the control key assembly formed when the control key extension is secured to the operating key acts as a control key. The lever end 202 and web 200 of extension 263 may be made of metal, such as hardened steel, having a nominal thickness 'x' which may be as little as approximately 0.010 inches which is substantially less than the thickness of key 63. The extending portion 201 may be integrally formed with the web 200 and lever end 202 of hardened steel but its thickness will be greater. Wall 210 will, for example, have a height corresponding to the thickness of key 63. In this connection the drawings show appreciable thickness for each of lever end 202 and web 200 for illustration purposes. Although it will be appreciated that the actual proportion in comparison with key shaft 100 may be thinner. The wall 210 is generally of a height which results in a substantially flush surface when the operating key 63 is seated on the extension 263 body so that smooth operation of the control key assembly within a keyway (such as keyway 50 in FIG. 1) is enhanced. In view of the nominal thickness 'x' of the web 200 and lever end 202 the difference between the operative thickness of the operating key 63 and the control key assembly will be 'x' provided a tight fit exists between the assembly components. It is found that most locking cores will accept control key assemblies which are moderately thicker than the operating key without substantially detracting from efficient operation. Where existing keyway tolerances do not readily allow variations of 0.010 inches, simple adjustments may be made during the subsequent manufacturing process of the cores or keys thereby permitting such variability.

The control key assembly 203 comprises the operating key 63 and the extension 263 secured together. The combined bitted segments 100 and 201 are capable of activating all corresponding operating tumblers 61 and control tumblers 62. The arrangement and configuration of bitted extending portion 201 on the extension 263 may be modified according to the number and type of control tumblers 62 to be activated in a given application.

Figure 2:
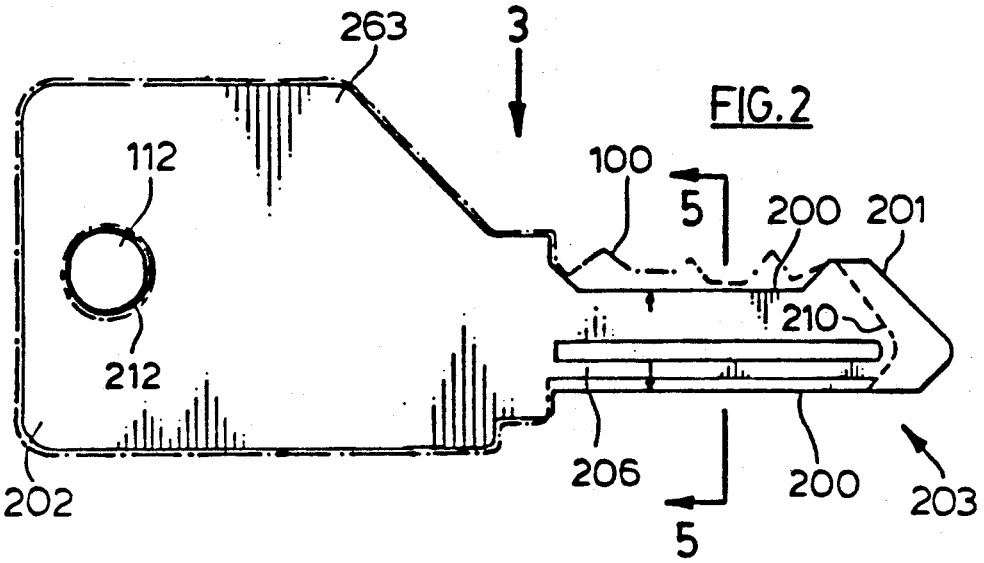
FIG. 2 is a plan view of one embodiment of the present invention.
Figure 3:
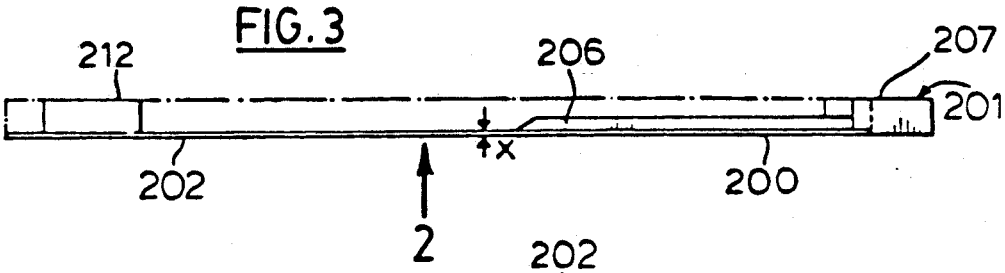
FIG. 3 is an elevation of this embodiment.
Figure 4:
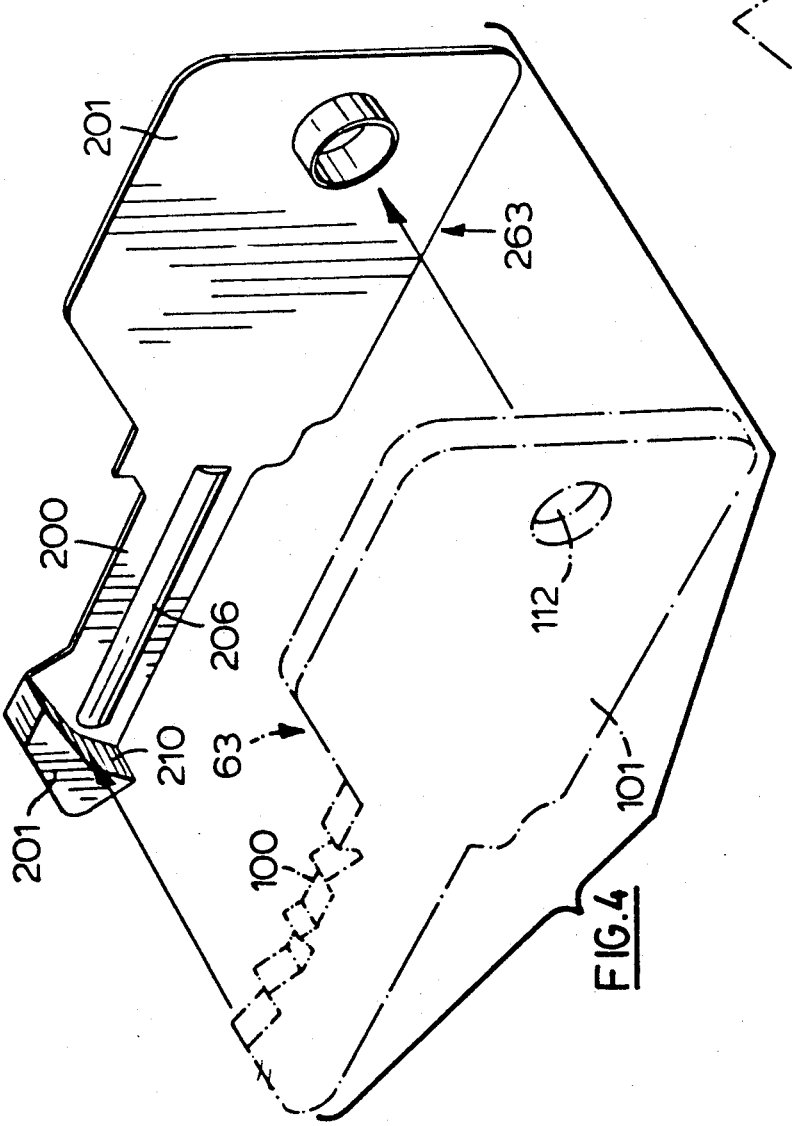
FIG. 4 is an exploded view of the extension and the key of FIG. 2.

Operating keys may have one or more grooves 106 running along the key shaft portions. Rib 206 is shown in FIGS. 2, 3 and 4 for engagement with one such groove in a corresponding operating key. Where more than one such groove is provided in an operating key, corresponding ribs may be rolled, pressed, stamped or otherwise formed in the extension member shaft to engage with such grooves. Once secured to the extension 263, the operating key rib 206 reduces the tendency of the bitted portion 201 to flare away from the operating key parallel to the planes of the key 63 and extension 263 after repeated use in a locking core. It can be seen that rib 206 provides reinforcement along the web shaft 200 of the extension 263.

Various means may be employed to secure the extension 263 to an operating key 63. In FIG. 6, an alternate embodiment of the securement means is shown. A hole 212 is provided in the lever end 202 of extension 263 having a diameter substantially equal to the size of the hole 112 in a corresponding control key. Holes 212 and 112 are intended to permit placement of the key assembly on a key chain or key ring when in use. A flange portion 219 is provided at the lever end 202 of the body. The flange 219 upstands from the lever end 202 by a distance to span the thickness of the lever 102 of key 63. Flange 219 has an edge portion 220 to snap over and hold the lever 102.

The flange segments may then be bent, rolled or otherwise shaped to clamp around the lever 102 of the operating key.

Although only one outline of an operating key is shown in FIG. 2, operating keys having different bitted segments may be utilized with one standardized extension body. The height of the shaft portion 200 may be selected to be sufficiently narrow to avoid interference with the bitting on a range of operating keys. The length and configuration of such operating keys must be suitable to permit the securement means to interact to secure the extension adapter to the various operating keys.

Figure 8:
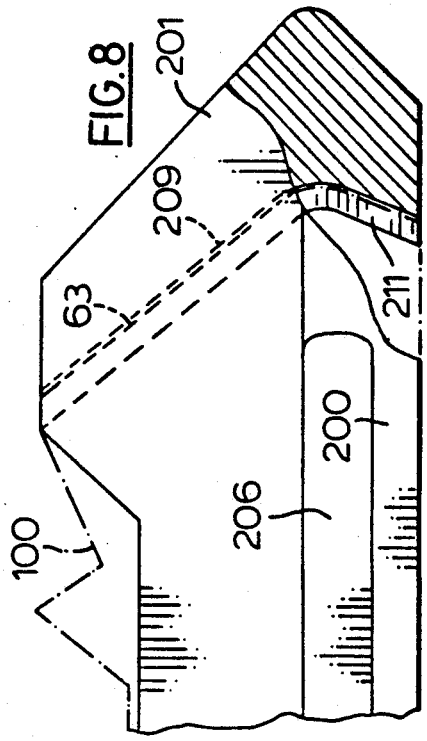
FIG. 8 is a plan view of a detail of yet another embodiment of the invention.

In another embodiment, (see FIG. 8), the wall may provide a lip 211 running substantially along the length of the wall 210. This lip 211 may form an overhang of wall 210 so that the lip 211 extends parallel with the intermediate web 200. The wall 210 forms the base of a channel having sides formed respectively by lip 211 and web 200 to more securely receive the corresponding distal end of the operating key 63. As shown in FIG. 7, the bitted extending portion 201 (more simply referred to as the nosepiece) may comprise a rib 215 upstanding from the plane of the extension. Ends 216 of the rib are shown to abut against terminal edge 209 of the operating key to engage the operating key. In this case ends 216 of rib 215 constitute wall 210 which in this case does not extend over the full extent of the distal end of key 63. The height of the rib 215 may be selected so that the top of the rib 215 is flush with the upper surface of the operating key. Where the outer edge 209 of the operating key is rounded or otherwise shaped, a corresponding overhang may be provided at ends 216 of the rib 215 to enhance positive engagement between corresponding ends of the key and extension body.

Rib 215 may be formed from a material stock of uniform thickness if such stock is used to make the adapter body. A collar or sleeve may be stamped, pressed or otherwise formed at the lever end 202 of the extension and rib 215 may also be stamped, pressed or otherwise formed at the bitted end 201 of the extension 263. It is therefore understood that an inexpensive adapter may be provided in this manner. Further useful modifications of the adapter described herein will occur to those skilled in the art and such modifications are intended to be covered by the following claims.

I claim:

1. A kit comprising a control key extension, an operating key and a locking core including locking tumblers and at least one control tumbler, the operating key comprising:

an elongate flattened bitted shaft having bits extending therefrom in a major plane of the shaft, proximal end and a distal end, and an operating lever provided at the proximal end, the extension comprising;

a bitted shaft extending portion having one end adapted to engage the distal end of the operating key to locate a major plane of the extending portion in the major plane of the operating key to extend it at the distal end of the key, and having at least one bit projecting therefrom to lie in the major plane of the key when said one end of the extending portion engages the distal end of the key;

a lever end having engagement means for engaging the key operating lever; and an elongate thin web connecting the extending portion and the lever end, the web having a first surface adapted to fit face to face with the flattened bitted shaft of the key and a second surface parallel to the first surface and its plane parallel with the major plane of the extending portion, the web having a longitudinally extending rib upstanding from the first surface, the rib being contoured for registration with a corresponding longitudinal groove of the key shaft.

2. A kit as claimed in claim 1 in which the control tumbler is adapted to disallow removal of the locking core from a housing in its first position and adapted to allow such removal in its second position.

3. A kit as claimed in claim 2 in which the engagement means comprise a resilient flange upstanding from the lever end adapted to engage with the operating lever of the key.

4. A kit as claimed in claim 2 in which the engagement means comprises a member upstanding from a planar surface of the lever end adapted to engage an aperture in the operating lever of the key.

5. A kit as claimed in claim 4 in which the height of the upstanding member corresponds generally to the thickness of the key.

6. A kit as claimed in claim 5 in which the upstanding member is an open ended sleeve adapted to extend axially in the aperture of the key.

7. A kit as claimed in claim 1 in which said one end of the extending portion comprises a wall contoured for engagement with the distal end of the key and upstanding from the first surface of the web.

8. A kit as claimed in claim 7 in which the height of the wall corresponds generally to the thickness of the key.

9. A control key extension having engagement means for an operating key of the type having an elongate flattened bitted shaft having bits extending therefrom in a major plane of the shaft and having a proximal end and a distal end, an operating lever being provided at the proximal end, the extension comprising:

a bitted shaft extending portion having one end adapted to engage the distal end of the operating key to locate a major plane of the extending portion in the major plane of the operating key to extend it at the distal end of the key, and having at least one bit projecting therefrom to lie in the major plane of the key when the one end of the extending portion engages the distal end of the key;

a lever end having engagement means for engaging the key operating lever; and an elongate thin web connecting the extending portion and the lever end, the web having a first surface adapted to fit face to face with the flattened bitted shaft of the key and a second surface parallel to the first surface and its plane parallel with the major plane of the extending portion, the web having a longitudinally extending rib upstanding from the first surface, the rib being contoured for registration with a corresponding longitudinal groove of the key shaft.

10. A control key extension as claimed in claim 9 in which the engagement means comprises a member upstanding from a planar surface of the lever end adapted to engage an aperture in the operating lever of the key.

11. A control key extension as claimed in claim 10 in which the height of the upstanding member corresponds generally to the thickness of the key.

12. A control key extension as claimed in claim 11 in which the upstanding member is an open ended sleeve located to extend axially in the aperture of the key.

13. A control key extension as claimed in claim 9 in which said one end of the extending portion comprises a wall contoured for engagement with the distal end of the key and upstanding from the first surface of the web.

14. A control key extension as claimed in claim 13 in which the height of the wall corresponds generally to the thickness of the key.

15. A control key extension as claimed in claim 9 in which the engagement means comprise a resilient flange upstanding from the lever end adapted to engage with the operating lever of the key.

16. In combination, a control key extension and an operating key, the operating key comprising:

an elongate flattened bitted shaft having bits extending therefrom in a major plane of the shaft, a proximal end and a distal end and an operating lever provided at the proximal end, the extension comprising;

a bitted shaft extending portion having one end adapted to engage the distal end of the operating key to locate a major plane of the extending portion in the major plane of the operating key to extend it at the distal end of the key, and having at least one bit projecting therefrom to lie in the major plane of the key when said one end of the extending portion engages the distal end of the key;

a lever end having engagement means engaged with the key operating lever; and an elongate thin web connecting the extending portion and the lever end, the web having a first surface fitting face to face with the flatted bitted shaft of the key and a second surface parallel to the first surface and its plane parallel with the major plane of the extending portion, the web having a longitudinally extending rib upstanding from the first surface, the rib being contoured for registration with a corresponding longitudinal groove of the key shaft.

17. A combination as claimed in claim 16 in which the engagement means comprises a member upstanding from a planar surface of the lever end adapted to engage an aperture in the operating lever of the key.

18. A combination as claim 17 in which the height of the upstanding member corresponds generally to the thickness of the key.

19. A combination as claimed in claim 18 in which the upstanding member is an open ended sleeve extending axially in the aperture of the key.

20. A combination as claimed in claim 16 in which said one end of the extending portion comprises a wall engaging with the distal end of the key and upstanding from the first surface of the web.

21. A combination as claimed in claim 21 in which the height of the wall corresponds generally to the thickness of the key.

22. A combination as claimed in claim 16 in which the engagement means comprises a resilient flange upstanding from the lever end resiliently engaging the operating lever of the key.

* * * * *